US006843391B2

(12) United States Patent
Jones

(10) Patent No.: US 6,843,391 B2
(45) Date of Patent: Jan. 18, 2005

(54) GAS RECLAMATION SYSTEM

(75) Inventor: Glyn Jones, Sheffield (GB)

(73) Assignee: Stanwell Technic Limited (GB)

( * ) Notice: Subject to any disclaimer, the term of this patent is extended or adjusted under 35 U.S.C. 154(b) by 0 days.

(21) Appl. No.: 10/297,784

(22) PCT Filed: Jun. 8, 2001

(86) PCT No.: PCT/GB01/02522

§ 371 (c)(1),
(2), (4) Date: Aug. 28, 2003

(87) PCT Pub. No.: WO01/94252

PCT Pub. Date: Dec. 13, 2001

(65) Prior Publication Data

US 2004/0026456 A1 Feb. 12, 2004

(30) Foreign Application Priority Data

Jun. 8, 2000 (GB) ..... 0013852

(51) Int. Cl.[7] ..... B65D 83/00

(52) U.S. Cl. ..... 222/399; 222/190; 222/189.06; 222/318; 55/466

(58) Field of Search ..... 222/190, 399, 222/189.06, 400.7, 400.8, 318; 55/466

(56) References Cited

U.S. PATENT DOCUMENTS 2,149,633 A 3/1939 Schnoor
3,989,461 A * 11/1976 Skocypec et al. ..... 422/111
4,330,038 A * 5/1982 Soukup et al. ..... 166/267
4,409,102 A * 10/1983 Tanner ..... 210/603
4,452,676 A * 6/1984 Birbara et al. ..... 205/628
4,515,607 A * 5/1985 Wolde-Michael ..... 96/159
4,699,642 A * 10/1987 Perry et al. ..... 62/541
4,905,685 A * 3/1990 Olsson et al. ..... 128/203.12
5,441,088 A * 8/1995 O'Neill et al. ..... 141/51

FOREIGN PATENT DOCUMENTS

DE 2658788 A1 7/1977
GB 2276678 A 10/1994
NL 7706025 12/1978

* cited by examiner

*Primary Examiner*—Frederick Nicolas
(74) *Attorney, Agent, or Firm*—Piper Rudnick LLP

(57) ABSTRACT

A gas reclamation system for use in a beverage dispensing system. The system includes a valve for releasable connection to a used beverage container containing a pressurized gas, the valve allowing release of gas from the container. A filter for removal of particulate matter from the gas and a sterilizer for removal of bacteria from the gas are also provided, together with a compressor to re-pressurize the filtered and sterilized gas for supply to the beverage dispensing system. The system may be used for carbon dioxide recovery from beverage containers, reducing the consumption of carbon dioxide from beverage dispensing systems.

11 Claims, 4 Drawing Sheets

GAS RECLAMATION SYSTEM

TECHNICAL FIELD OF THE INVENTION

The present invention relates to a gas reclamation system, particularly but not exclusively to a gas reclamation system for use in recovering carbon dioxide or other gases from kegs containing pressurized beverages.

BACKGROUND

Draught beverages such as lager and bitter beers, cider and stout are served in bars using pressurized systems. The beverage is supplied to the bar in kegs and is pressurized with carbon dioxide or a mixture of carbon dioxide and nitrogen. This "top pressure" may be up to 2.81 kg $cm^{-2}$ (40 p.s.i.) in the case of lager beers. The latest approach to dispensing such beverages has a requirement for even higher top pressures. In order to maintain the pressure in the keg at an approximately constant level, carbon dioxide and optionally nitrogen is pumped into the keg as the beverage is supplied to the consumer. If the pressure in the keg dropped, carbon dioxide would be allowed to escape from the beverage during storage, creating foaming or fobbing of the beverage, which is undesirable. The additional carbon dioxide is supplied from bottles that are attached to the bar's dispensing system.

Kegs that have been emptied of liquid (and are hence full of pressurized gas) are returned to the brewery from the bar, where they are vented to atmosphere before being re-filled with beverage. This venting constitutes a significant source of carbon dioxide emissions, and as $CO_2$ is a "greenhouse" gas it is therefore desirable to reduce the amount of these emissions to a minimum. In addition, in order to fill the kegs with carbon dioxide, the bar must regularly purchase or lease bottles of $CO_2$, which are expensive. There is also in environmental impact from the supply of the bottles to different bars, as there are exhaust emissions from the delivery trucks.

It is an object of the present invention to obviate or mitigate these disadvantages with prior art systems, and to provide a gas reclamation system to lessen the need for supplying large quantities of carbon dioxide to run beverage dispensing systems in bars.

SUMMARY OF THE INVENTION

According to a first aspect of the present invention there is provided a gas reclamation system for use in a beverage dispensing system comprising a coupler for releasable connection to a used beverage container containing a pressurized gas, the coupler allowing release of gas from the container, and a compressor connected to the coupler and arranged to pressurize released gas for supply to the beverage dispensing system.

Preferably, a gas sensor, a pressure sensor, a filter, and a sterilizer are provided upstream of the compressor. The sterilizer may comprise an ionizer and a de-ionizer. Optionally a collecting tank may be provided upstream of the compressor, or one or a plurality of collecting tanks may be provided downstream of the compressor. A separator may also be provided to separate different gases, one of which is passed to the compressor. This may be used if the gas in the container is a mixture of gases such as nitrogen and carbon dioxide. Alternatively different gases/gas mixtures may be selectively delivered to different collection tanks.

One or more of the above components may be under the control of a central processing unit. In this way collection of the gas being reclaimed may be automatically regulated (e.g. delivered to an appropriate collection vessel).

The gas to be reclaimed may be carbon dioxide. The gas reclamation system according to the present invention reduces the amount of carbon dioxide that is used in beverage dispensing systems, and thus reduces harmful $CO_2$ emissions to the atmosphere. The reduction in consumption of $CO_2$ also means that the cost of running a beverage dispensing system is substantially reduced.

According to a second aspect of the present invention there is provided a beverage dispensing system comprising a gas reclamation system according to any preceding claim, a dispensing coupler for connection to a container from which a beverage is to be dispensed, and a gas supply line connected to the dispensing coupler to supply pressurised gas to the container, the compressor being connected to supply pressurised gas to the gas supply line.

BRIEF DESCRIPTION OF THE DRAWINGS

An embodiment of the present invention will now be described by way of example with reference to the accompanying drawings, in which.

DETAILED DESCRIPTION OF THE PREFERRED EMBODIMENTS

Figure 1:
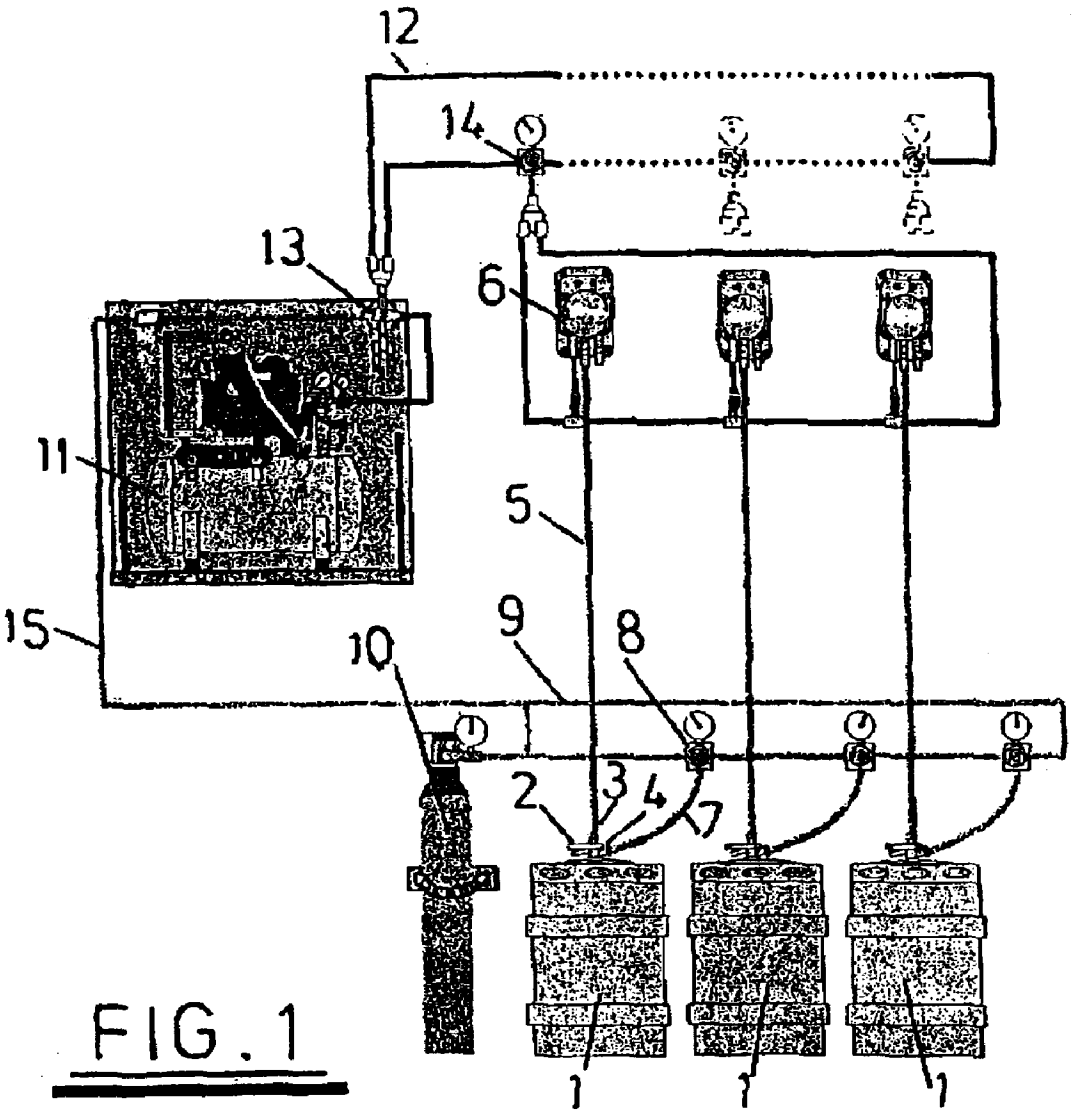
FIG. 1 is a schematic illustration of a prior art beverage dispensing system.

Referring to FIG. 1 of the accompanying drawings, there is illustrated a prior beverage dispensing system comprising a plurality of kegs 1, each connected to a keg coupler 2 provided with two valves 3, 4. One of the valves 3 of each keg coupler 2 is attached to a line 5. Each line 5 is attached at its other end to a dispense head gas pump 6 which is powered using compressed air, which is typically provided on a bar to dispense draught beverages, and may be provided some distance from the remainder of the beverage dispensing system, including the kegs, which may typically be placed in a cellar of the bar.

The valves 4 of the keg couplers 2 are each connected to a line 7 that is attached at its other end to a valve 8 provided on a gas ring main 9. A carbon dioxide supply bottle 10 is also attached to the gas ring main 9.

A compressor 11 is attached to an air ring main 12, and supplies pressurized air to the air ring main 12 via valves 13 and 14 in order to drive the dispense heads 6. The gas bottle 10 is also connected to the valve 13 via line 15, the valve 13 being arranged to supply carbon dioxide to the dispense heads from the gas bottle 10 in the event that the air compressor fails.

As beer or another beverage is dispensed from dispense heads 6, carbon dioxide from supply bottle 10 is used to maintain a roughly constant top pressure in the kegs 1. As a result, once all the beverage within a keg has been dispensed, the keg is full of pressurized carbon dioxide. The bottle 10 must be changed frequently as the carbon dioxide is used up.

Figure 2:
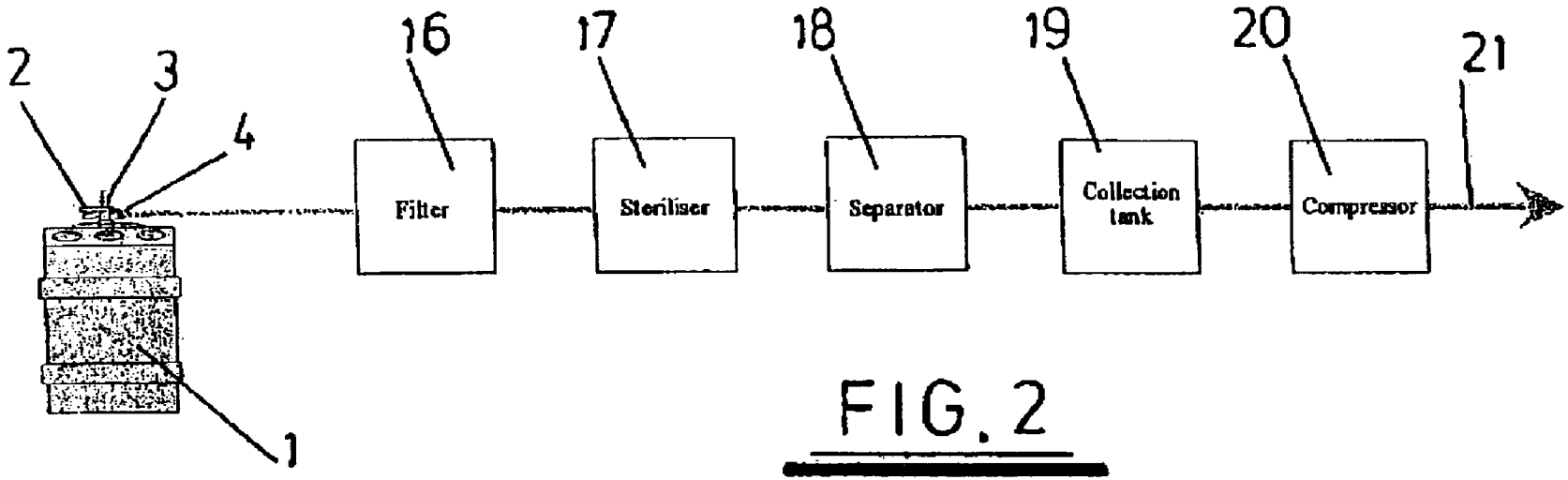
FIG. 2 is a schematic illustration of a gas reclamation system according to the present invention.

Referring now to FIG. 2, a gas reclamation system according to the present invention is illustrated which can be used to recover carbon dioxide from a keg taken from a system such as that shown in FIG. 1. It comprises an input line attached to a keg coupler 2 for connection to a gas-filled keg 1, the line feeding to, in sequence, a filter 16, a steriliser 17, a separator 18, a first collection tank 19*a*, a food quality compressor 20 and finally to an outlet line 21. The collection tank 19*a* serves to limit the pressure applied to the inlet of the compressor 20 from the keg 1. The outlet line 21 could be connected to, for example, a gas storage bottle such as the bottle 10 of FIG. 1, but is preferably connected to the gas ring main of the beverage dispense system, as shown in FIG. 3.

Figure 3:
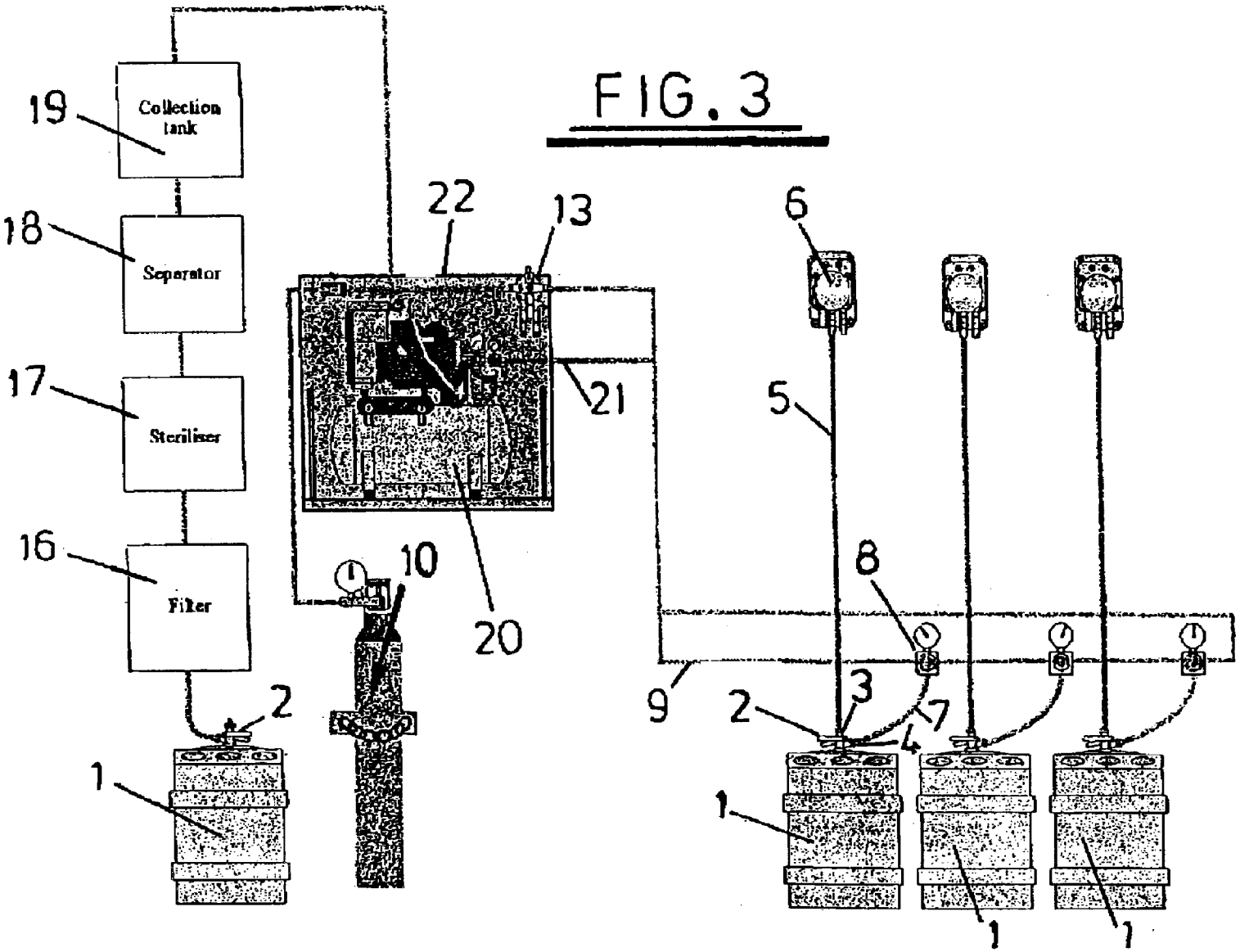
FIG. 3 is a schematic illustration of a beverage dispensing system incorporating the gas reclamation system of FIG. 2.

The same reference numerals are used where appropriate in FIGS. 1, 2 and 3. The compressor 20 is provided in a compressor station 22 which also includes a second collection tank 19*b* to receive gas compressed by the compressor 20. The compressor outlet line 21 is connected to the gas ring main 9 via pressure regulator valve 13. The gas bottle 10 is also connected to the gas ring main 9 through the valve 13 such that gas is supplied from the bottle 10 only when the compressor 20 and the associated collection tank 19*b* are unable to maintain the required top pressure within the kegs 1 connected to the gas ring main 9.

In the embodiment shown in FIG. 3, the pressure required to work the dispense heads 6 is drawn from a separate air ring main (not shown) with its own compressor. A one-way valve (not shown) could be provided from the gas ring main 9 to the air ring main in order to supply carbon dioxide from the gas ring main in the event that there is not enough pressure in the air ring main to power the dispense heads.

The use of the system is as follows:

Full kegs 1 are connected to the keg couplers 2 that are attached to the dispensing lines 5 and the beverage is dispensed from the heads 6. As the pressure in a keg 1 falls due to the beverage being dispensed, the valves 4 open to introduce carbon dioxide into the keg 1 from the gas ring main 9 in order to keep the pressure within the keg within predetermined levels.

Once all the beer or other beverage has been dispensed from the keg, and the keg is full of carbon dioxide, the keg 1 is disconnected from the dispensing system by removal of keg coupler 2. A valve (not shown) on the keg prevents any egress of the contents during movanent thereof. The keg is then moved to the reclamation system, and attached to the keg coupler 2 that is connected to the inlet line that is coupled to the filter 16, which releases the pressurized gas from the keg into the reclamation system. The gas is first passed through filter 16. The filtration process removes any fluid contents from the gas, together with particulate matter. The gas is then passed into sterilizer 17 to remove any bacteria therefrom. After sterilization, separator 18 separates any nitrogen from the carbon dioxide and thereby assists in the recovery of the $CO_2$. The nitrogen may be vented to atmosphere, or may be collected separately from the $CO_2$. If the system does not include nitrogen gas, the separator 18 may be omitted.

The resultant $CO_2$ is then collected in collection tank 19 before being re-pressurized by the compressor 20 in order to be supplied to the gas ring main 9. A collection rate of approximately 80% of reusable gas is obtainable by this process. A higher collection rate is not thought to be optimal because a large amount of particulate matter and bacteria remain in the final 20 of the gas left in the keg, which would require more sophisticated cleaning and filtration steps, and hence would be more expensive to operate. In addition, the remaining contents of the keg may have to be removed under a reduced pressure rather than at atmospheric pressure. However, collection of the final portion of $CO_2$ may be desirable in some circumstances.

It should be appreciated that, although a $CO_2$ bottle 10 is provided in this system as a back-up to the reclamation system, the amount of additional $CO_2$ that needs to be added to the drinks dispensing system is greatly reduced in comparison with prior art systems. The bottle 10 should therefore only need to be replaced infrequently.

Figure 4:
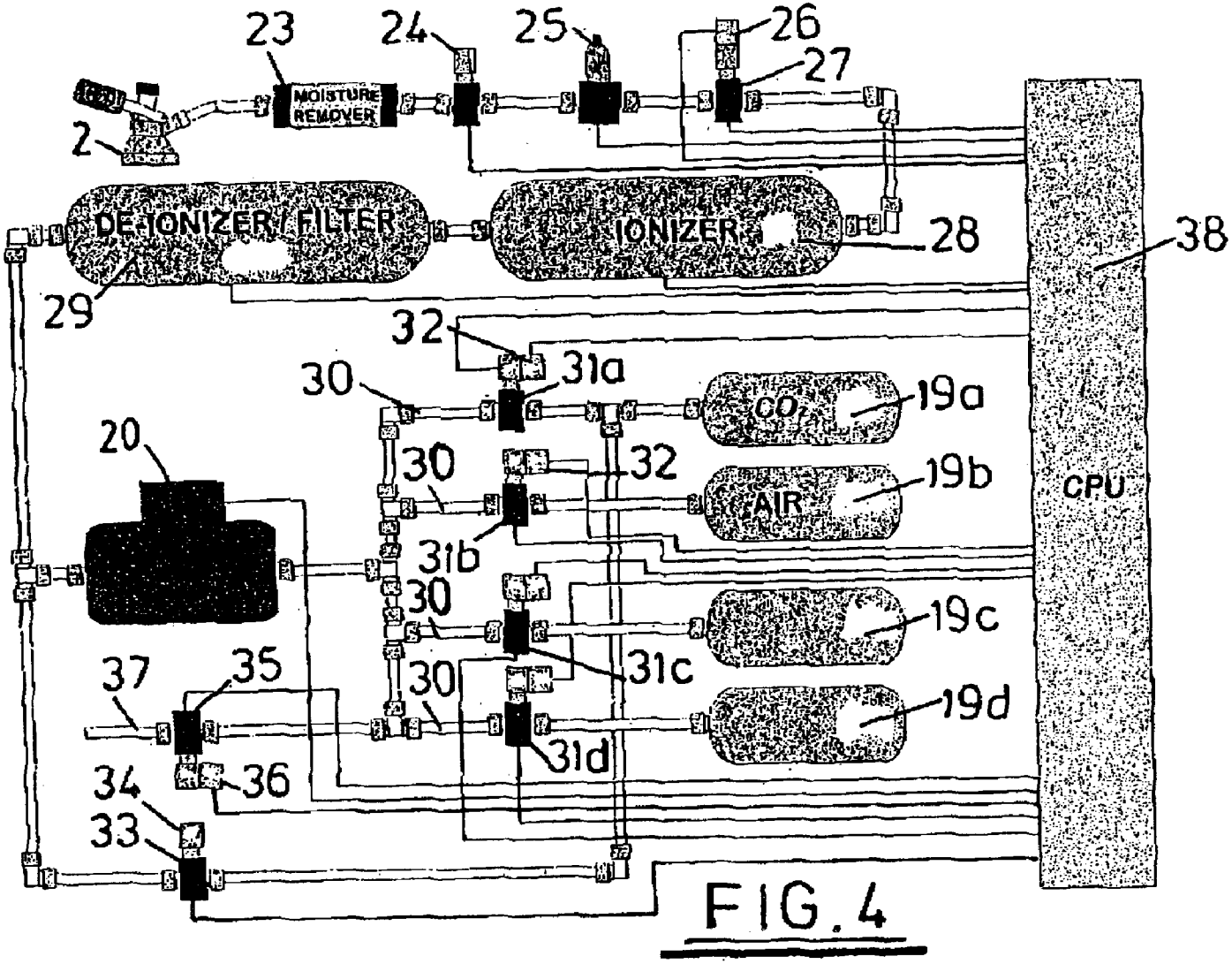
FIG. 4 is a schematic illustration of a second embodiment of a gas reclamation system according to the present invention

Referring to FIG. 4 a second embodiment of a gas reclamation system according to the present invention is illustrated which can be used to recover carbon dioxide and other gases and gas mixtures such as nitrogen and nitrogen/$CO_2$ from a keg.

The system comprises an input line attached to a keg coupler 2 for connection to gas filled keg. The keg coupler 2 will be of modified form as compared with a keg coupler used for dispensing beverage. In particular, the modified keg coupler 2 has a capped-off product port and a modified gas input port. In a conventional keg coupler used for dispensing beverage, the gas input port has a one way valve permitting gas flow only into the keg. In the modified keg coupler, the one way valve is reversed so as to allow gas flow only out of the keg. The modified gas port is used to recover gas from the keg so as to reduce the risk of product contamination from any beverage that may still be in the keg. If the conventional product port was used, this port connects to a lance that extends to the bottom of the keg so as to enable top pressure to force beverage out of the keg. That lance could readily be contaminated by residual beverage in the port and therefore it is advantageous to recover gas from a port open only into the top of the keg. The modified input port provides such a connection.

The coupler 2 is connected in series to a moisture remover 23, an anti-vacuum valve 24, a gas sensor 25, a pressure sensor 26 mounted on a solenoid valve 27, a sterilizer comprising an ionizer 28 and a de-ionizer 29, and a compressor 20. In this embodiment, there is no equivalent component to the collection tank 19*a* upstream of the compressor 20 in FIG. 3. Four gas collection or storage tanks 19*a*, 19*b*, 19*c*, 19*d* are however connected downstream of the compressor 20 via collection lines 30 and respective valves 31*a*, 31*b*, 31*c* and 31*d*, each of those valves incorporating a respective pressure sensor 32. The collection tank 19*a* is connected by a valve 33 incorporating a pressure sensor 34 to the inlet to the compressor 20, and the lines 30 are connected by a valve 35 incorporating a pressure sensor 36 to an outlet 37. A central processing unit (CPU) 38 is connected to each valve, each pressure sensor, the compressor 20, the anti-vacuum valve 24 and the gas sensor 25.

On initial installation, the CPU 38 performs a series of pressure checks. This is carried out by opening valve 27 and operating compressor 20 with all the valves 31*a, b, c* and *d* open. The tanks 19*a, b, c*, and *d* are thus pressurised to a preset pressure. The valves 31*a, b, c*, and *d* are then closed and the gas pressure in each of the tanks is monitored by the pressure sensors 32. This is to ensure that the tank pressures are maintained as will be the case if the tanks are not leaking, If the tanks are shown to be gas tight, the system is then ready for use. Before use however the tanks are emptied by opening valves 31*a, b, c* and *d* and opening valve 35 so that the tanks are vented to atmosphere. The system is now fill of air at atmospheric pressure.

Before a keg is connected to the coupler 2, the system is evacuated to remove most of the air. The coupler 2 incorporates a valve (not shown) which is closed until the coupler is connected to a keg During the evacuation process, the valve 35 is opened, the compressor 20 is turned on, and the valves 33 and 27 are opened. After a predetermined period the valve 27 will be closed (at which point a partial vacuum has been established in the line between the coupler 2 and the valve 27). Thereafter the compressor continues to operate until a full vacuum is established in tank 19*a* and all the lines between the tank 19*a* via valve 33 to valve 27. This reduces the amount of air in the system which could contaminate subsequently collected gas. The tanks 19*b*, 19*c* and 19*d* will however still be full of air at atmospheric pressure as will the lines 30 downstream of the compressor.

When a keg is delivered filled with pressurised gas, it is connected to the coupler 2, such connection automatically opening the valve incorporated in the coupler 2 so that the line upstream of the valve 27 is in communication with the interior of the keg. Gas from the keg passes through the moisture 23 which drives the gas. The incoming gas pressure is monitored by the pressure sensor 26 associated with the valve 27. The gas sensor 25 detects the identity of the incoming gas. If the incoming gas is carbon dioxide, that gas is to be delivered to the tank 19*a* (which is evacuated as a result of the earlier action of the compressor 20). Assuming that the detected gas is carbon dioxide, the valve 27 is opened, the valve 31*a* is opened, and the compressor 20 is turned on so as to deliver carbon dioxide from the coupler 2 into the tank 19*a*. If on the other hand the gas detected by the sensor 25 is air, this gas should be delivered to the tank 19*b* and therefore the valve 31*b* is open rather than the valve 31*a*. The delivered air will be mixed with the air already in the tank 19*b* but this does not result in any cross-contamination. Similarly, gas may be delivered to the tanks 19*c* and 19*d* by appropriate control of the valves 31*c* and 31*d*. If some cross-contamination between the air originally in these tanks and the delivered gas is not a problem then the illustrated arrangement is sufficient. If however the delivered gas is for example nitrogen and cross-contamination with air is not acceptable, it would be necessary to provide an additional purge valve corresponding to the valve 33 connected by a T-junction to the pipe linking the tank to the associated valve 31*c* or 31*d* to enable evacuation of that tank before delivery of recovered gas.

As soon as the valve 27 is opened, the ionizer 28 and de-ionizer/filter 29 are turned on and compressor 20 is started. The processor 38 will then monitor the inlet pressure detected by a pressure sensor 26 and will also monitor the gas storage pressure of the tank to which the gas is being delivered via pressure sensor 32. If the storage pressure exceeds a preset level the compressor 20 will stop and the valve 31 *a, b, c* or 4 will be closed.

After the gas pressure within the keg connected to the coupler 2 as sensed by the pressure sensor 26 indicates that the keg has been evacuated the valve 27 will be closed. The coupler to is then disconnected from the keg, thereby closing the automatic valve embodied within the coupler 2 and the process can be repeated, that is the valve 35 will be opened, the compressor 20 will be started, and the system will be evacuated until a predetermined low pressure is established upstream of the valve 27, whereupon that valve is closed. Further evacuation continues until the system is fully evacuated. The process can be repeated thereafter by connecting a new keg to the coupler 2.

The CPU 38 performs various additional functions. For example, once a keg has been connected to the coupler 2 the processor 38 will check to see that the pressure within the keg is within preset limits. In addition, the processor 38 will monitor the pressure within the appropriate tank 19*a* to *d* to see if there is enough space in that tank to receive the keg contents. If either the keg pressure is inadequate or the tank pressure is too high the processor 38 will abort the cycle and indicate to the user that the selected storage tank is full. If on the other hand the tank does provide enough space to receive the keg contents, the processor 38 may vent a small amount of its contents into the system by opening the associated valve 31*a* to 31*d* to flush gas out of the pipes 30 via the valve 35. This again reduces the risk of cross-contamination.

The ionizer 28 uses a high voltage negative ion to purify any contaminations found within the gas stream. The ionizer 28 is turned on once the processor 38 has indicated initiation of a valid gas recovery cycle. Incoming gas passed by the valve 27 will be totally ionized, thereby killing any bacterial or other contaminations found with it. After purification, de-ionization and filtering, the gas is drawn by the compressor 20 into the appropriate tank. Filtering will remove any biomass or airborne matter before the gas reaches the storage tank.

After completion of a recovery cycle, the processor 38 will indicate to the user that the cycle has been completed. Once the processor 38 has checked that the inlet system has been cleared, that is the keg coupler 2 has been disconnected and the line upstream of the valve 27 is at normal atmospheric pressure, the system will automatically start the process described above to clear gas from the system in anticipation of the next gas reclamation cycle.

The anti-vacuum valve 24 may be operated in the event that the compressor 20 stalls on start-up. Fault diagnostics may also be provided to ensure that the compressor 20 is functional by monitoring the pressure rise on starting. If no rise is detected when the compressor 20 starts, then a fault situation will be displayed on a control panel.

The gas sensor 25 may be set up to detect the presence of three gas types, for example carbon dioxide, nitrogen and oxygen A standard sensor can be used which relies on the principle of infra-red absorption. This process can accurately determine the identity of a gas present in a sampling chamber which is part of the sensor. The sensor can be calibrated using pure sample gas as references, the processor 38 thereafter storing this reference data for use in identifying the presence of particular gases within the system. Such IR absorption sensors are very low maintenance and do not require permanent stored sample gas to maintain their accuracy.

In the arrangement shown in FIG. 4, no connections have been shown for delivering pressurised gas from the tanks 19*a* to 19*d*. Any convenient arrangements may be provided for such gas delivery. For example, in the case of tank 19*a*, a simple T-junction (not shown) on the inlet to the tank 19*a* may be connected through a one way valve system to a beverage dispensing line such as the line 9 shown in FIG. 3. Gas would therefore be delivered from tank 19*a* as necessary providing the pressure within the tank 19*a* was sufficiently high.

What is claimed is:

1. A gas reclamation system for use in a beverage dispensing system comprising:

a coupler for releasable connection to a used beverage container containing a pressurized gas, the coupler allowing release of gas from the container, a compressor connected to the coupler and arranged to pressurize released gas for supply to the beverage dispensing system, and a sterilizer provided up stream of the compressor to remove bacteria from the released gas.

2. A gas reclamation system according to claim 1, wherein a gas sensor is provided upstream of the compressor to identify the gas being reclaimed, and means are provided to direct reclaimed gas selectively to one or more storage tanks in dependence upon the gas identity.

3. A gas reclamation system according to claim 1, wherein a pressure sensor is provided upstream of the compressor, and means are provided to terminate operation of the compressor if the sensed pressure falls below a predetermined limit.

4. A gas reclamation system according to claim 1, wherein a collection tank is provided upstream of the compressor.

5. A gas reclamation system according to claim 1, wherein a separator is provided to separate different gases, one of said gases is passed to the compressor.

6. A gas reclamation system according to claim 2, wherein a plurality of collection tanks are provided downstream of the compressor, and the gas directing means comprises a series of valves connected between the compressor and respective collection tanks.

7. A gas reclamation system according to claim 1, wherein the gas to be reclaimed is carbon dioxide.

8. A gas reclamation system according to claim 1, wherein a filter is provided upstream of the compressor.

9. A gas reclamation system for use in a beverage dispensing system comprising:

a coupler for releasable connection to a used beverage container containing a pressurized gas, the coupler allowing release of gas from the container;

a compressor connected to the coupler and arranged to pressurize released gas for supply to the beverage dispensing system; and means for purging the system after a gas reclamation procedure.

10. A gas reclamation system for use in a beverage dispensing system comprising:

a coupler for releasable connection to a used beverage container containing a pressurized gas, the coupler allowing release of gas from the container;

a compressor connected to the coupler and arranged to pressurize released gas for supply to the beverage dispensing system; and a sterilizer provided upstream of the compressor and including an ionizer and a de-ionizer.

11. A beverage dispensing system comprising:

a coupler for releasable connection to a used beverage container containing a pressurized gas, the coupler allowing release of gas from the container, a compressor connected to the coupler and arranged to pressurize released gas for supply to the beverage dispensing system, a sterilizer provided up stream of the compressor to remove bacteria from the released gas, a dispensing coupler for releasable connection to a container from which a beverage is to be dispensed, a gas supply line connected to the dispensing coupler to supply pressurized gas to the container, and a compressor connected to the dispensing coupler to supply pressurized gas to the gas supply line.

* * * * *